US005510668A

United States Patent [19]

Rohwein et al.

[11] Patent Number: 5,510,668

[45] Date of Patent: Apr. 23, 1996

[54] SPARK GAP WITH LOW BREAKDOWN VOLTAGE JITTER

[75] Inventors: Gerald J. Rohwein; Lars D. Roose, both of Albuquerque, N.M.

[73] Assignee: Sandia Corporation, Albuquerque, N.M.

[21] Appl. No.: 228,987

[22] Filed: Apr. 18, 1994

[51] Int. Cl.[6] ..... H01T 13/20

[52] U.S. Cl. ..... 313/141; 313/122; 313/136

[58] Field of Search ..... 313/141, 142, 313/143, 589, 618, 132, 133, 135, 136, 144; 361/247, 253; 307/123

[56] References Cited

U.S. PATENT DOCUMENTS

| | | | |
|---|---|---|---|
| 195,358 | 9/1877 | Hill | 361/253 |
| 1,190,130 | 4/1916 | Duffy | 313/132 |
| 1,353,785 | 9/1920 | Platt | 313/132 |
| 1,359,996 | 11/1920 | Kahn | 313/133 |
| 1,486,710 | 3/1924 | Whittier . | |
| 1,508,460 | 9/1924 | Mansfield | 313/133 |
| 1,512,319 | 10/1924 | Stuver | 313/142 |
| 1,522,227 | 1/1925 | Bragger | 313/133 |
| 1,872,302 | 8/1932 | Knowles | 313/618 |
| 1,900,577 | 3/1933 | Moore | 313/621 |
| 2,120,492 | 6/1938 | Graf | 313/133 |
| 2,944,178 | 7/1960 | Schaub | 313/141 |
| 4,015,160 | 3/1977 | Lara et al. | 313/139 |
| 4,023,058 | 5/1977 | Lara et al. | 313/139 |
| 4,370,175 | 1/1983 | Levatter | 148/1.5 |
| 4,428,193 | 1/1984 | Papp | 60/509 |
| 4,498,183 | 2/1985 | Levatter | 372/86 |

FOREIGN PATENT DOCUMENTS

| | | | |
|---|---|---|---|
| 0562017 | 6/1977 | U.S.S.R. | H01I 61/10 |

*Primary Examiner*—Sandra L. O'Shea
*Assistant Examiner*—Vip Patel
*Attorney, Agent, or Firm*—Brian Dodson; George H. Libman

[57] ABSTRACT

Novel spark gap devices and electrodes are disclosed. The novel spark gap devices and electrodes are suitable for use in a variety of spark gap device applications. The shape of the electrodes gives rise to local field enhancements and reduces breakdown voltage jitter. Breakdown voltage jitter of approximately 5% has been measured in spark gaps according the invention. Novel electrode geometries and materials are disclosed.

11 Claims, 2 Drawing Sheets

SPARK GAP WITH LOW BREAKDOWN VOLTAGE JITTER

The United States Government has rights in this invention pursuant to Contract Number DE-AC04-76DP00789 between the Department of Energy and the American Telephone and Telegraph Company.

BACKGROUND OF THE INVENTION

A spark gap device is an arrangement of electrodes between which a spark may occur. Spark gaps devices have applications as a pulsed heat source (automotive spark plugs as one example), a pulsed light source, and as a high voltage switch (pulsed power systems and lightning shunts for example). In these applications, the spark gap is designed to conduct once the applied voltage reaches a predetermined value.

Many spark gap device designs have been proposed. J. S. Whittier in U.S. Pat. No. 1,486,710 discloses an automotive spark plug with a hole drilled in the tip of one electrode. According to this patent, the hole causes the gap to produce a hollow cylindrical spark. The electrode face has sharp edges, and the sides have a relief cut into them to discourage carbon deposition. T. S. Schaub in U.S. Pat. No. 2,944,178 discloses an automotive spark plug having a hole drilled all the way through a fiat electrode. A second electrode has a matching coaxial hole. The two electrodes are otherwise fiat and sharp cornered. The two holes are stated to produce a jetting action of the fuel-air mixture, reducing carbon deposition. Lara et. al. in U.S. Pat. Nos. 4,015,160 and 4,023,058 disclose a spark gap for automotive applications having two electrodes with facing holes. The electrodes are either fiat or chamfered with straight edges and sharp corners. The facing holes are said to produce a hollow column spark. While these inventions strive to affect the shape of the spark produced when the gap breaks down, they do not address the voltage and timing characteristics of the breakdown.

The breakdown voltage of the spark gap determines the precise timing of the spark. Variability of the breakdown voltage causes imprecision in the timing of the spark. This variability, termed voltage jitter, can be up to 50% and is a major source of difficulty with prior art spark gap and electrode designs. The imprecision in spark voltage and timing due to excessive jitter is also a major source of other difficulties in systems using spark gaps. An example of this is the case where multiple spark gap switches are required to switch simultaneously. Even with the same applied voltage, jitter in the breakdown voltage of the gaps can cause the gaps to fire at different times and voltages. In addition to the associated timing problems, asynchronous spark gap firing can cause significant portions of the applied energy to be wasted. Inefficient energy use is a major inhibitor to the use of pulsed power in applications such as food irradiation, sterilization, and flue gas pollution control.

One solution to the problems posed by breakdown voltage jitter is to employ triggered spark gaps. In this form of spark gap, the applied voltage is kept below the breakdown voltage of the gap. At the appropriate time, the gas breakdown is initiated via external means (often a laser). Multiple spark gaps can be triggered nearly simultaneously in this manner, and the timing and voltage imprecision is much less. Triggered spark gaps, however, are much more expensive than self breaking spark gaps due to the external triggering means. The added complexity and expense of triggered spark gaps discourages their use in many applications such as automotive spark plugs,food irradiation, and flue gas pollution control.

A point-plane spark gap device is known to have low jitter. In this gap, one electrode is a point and the other is a plane. The breakdown characteristics of this idealized geometry are predictable, and lead to low jitter. This idealized geometry is unsuitable for many applications, however, since it breaks down at lower voltages for given electrode separations.

SUMMARY OF THE INVENTION

An object of the present invention is to reduce the imprecision in spark timing in self breaking spark gaps.

Another object of the invention is reduce the breakdown voltage jitter of self breaking spark gaps.

Another object of the invention is to improve spark gap electrode designs so that low jitter self-breaking spark gaps can be realized.

Additional objects, advantages, and novel features will become apparent to those skilled in the art upon examination of the following description or may be learned by practice of the invention. The objects and advantages of the invention may be realized and attained by means of the instrumentalities and combinations particularly pointed out in the appended claims.

In one embodiment of the invention an end of one electrode of a spark gap is formed in the shape of a hemisphere. The surface of the hemisphere has a coaxial depression. This depression intersects the hemisphere's rounded surface, resulting in a circular ridge in the electrode face adjacent to the spark gap. In general, the ridge is formed as an edge of metal located and defined by the intersection of the hemispherical, exterior surface of the electrode with the boundaries of the coaxial depression thereby presenting a linear structure with a small acute angle in relation to the other electrode. The ridge is located relative to the other electrode such that the ridge is the closest portion of its electrode to the spark gap. Spark gaps with such electrodes have demonstrated superior breakdown voltage jitter over spark gaps using prior art flat electrodes.

Another embodiment of the invention has an electrode with one tapered end. This taper is intersected by a hole coaxial with the taper. The intersection produces a sharp ridge on the electrode face adjacent to the spark gap. Other geometries which produce a suitable ridge on the electrode face are also disclosed.

Further embodiments make use of specific materials to help reduce the breakdown voltage jitter. Complete self breaking spark gaps can be made using the electrode designs of the embodiments described above. Electrode inserts can be made according to the present invention for use in modifying electrodes made according to the prior art.

DESCRIPTION OF THE FIGURES

The accompanying drawings, which are incorporated into and form part of the specification, illustrate an embodiment of the invention and, together with the description, serve to explain the principles of the invention.

DETAILED DESCRIPTION OF THE INVENTION

Figure 1:
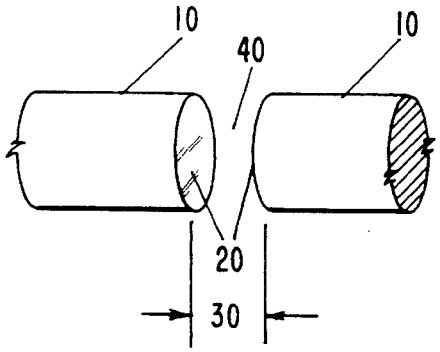
FIG. 1 is a prior art spark gap device.

FIG. 1 shows a prior art spark gap device. The electrodes 10 are approximately cylindrical in shape and present flat face surfaces 20 to the spark gap 30. Sufficient voltage applied across the electrodes will ionize the gas 40 there between, causing a spark across the gap between the electrodes. The voltage at which the spark occurs is termed the breakdown voltage. Experiments have shown that the breakdown voltage of a spark gap like that shown in FIG. 1 can vary widely depending on various factors such as the gas density between the electrodes, small variations in electrode configuration, oxide layers on the electrodes, electrode material, and residual ionization of the gas.

Figure 2:
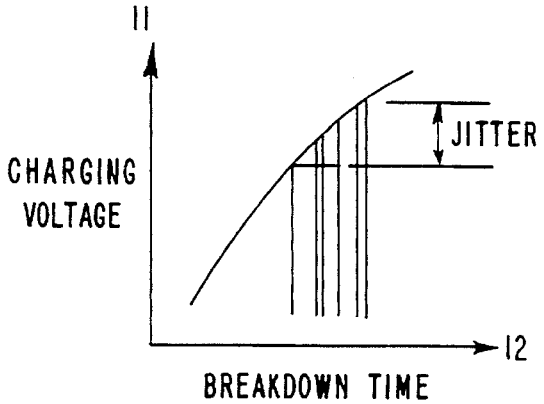
FIG. 2 is a graph of the charging voltage and breakdown times for a prior art spark gap device.

FIG. 2 shows the relationship between charging voltage 11 and breakdown times 12 for multiple shots of the spark gap of FIG. 1. As the figure shows, the breakdown voltage of this spark gap device varies. The variation in breakdown voltage for a given spark gap is termed its breakdown voltage jitter.

Figure 3A:
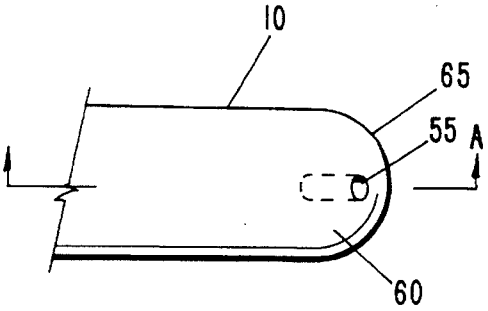
FIGS. 3*a* and 3*b* show full and cutaway views of an electrode according to the present invention.
Figure 3B:
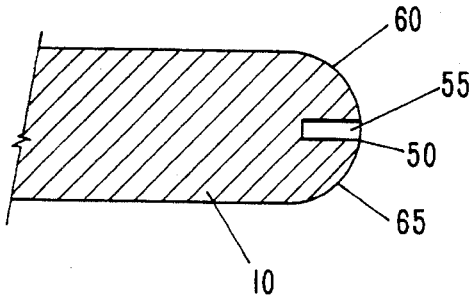

In FIGS. 3*a* and 3*b* an improved electrode according to the present invention is shown. A ridge 50 is formed at the end 65 of the electrode 10 to be adjacent to the spark gap. The cross-section of ridge 50, as seen in FIG. 3*b*, forms an angle of less than 180° in the material of electrode 10. The electrode face 55 within the ridge 50 is relieved. The electrode face 60 outside the ridge is also relieved. As shown in FIG. 3*b*, this combination results in the ridge 50 being the closest portion of the electrode to the spark gap.

Figure 4:
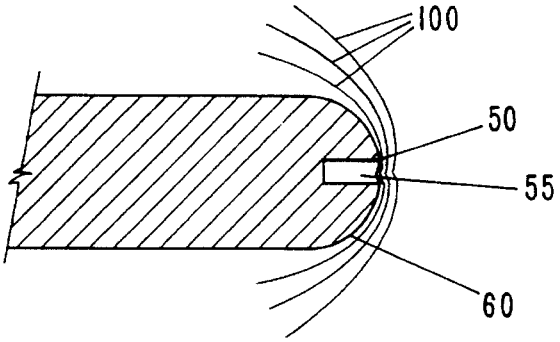
FIG. 4 is a representation of the equipotential lines around the electrode of FIG. 3.

FIG. 4 shows lines of equipotential 100 around an electrode according to this invention as a voltage is applied. The lines wrap evenly around the relieved outer portion 60, pinch tightly together at the ridge 50, then wrap evenly again across the portion within the relieved electrode face 55. The breakdown of the gas is most likely to occur where the equipotential lines are pinched tightly together. The novel electrode design maximizes the likelihood that the gas will breakdown near the ridge while minimizing the likelihood that it will break down anywhere else in the spark gap. This maximizes the repeatability of the spark gap breakdown performance, minimizing breakdown voltage jitter.

Sections through several other embodiments of the present invention are shown in FIG. 5*a* through 5*d*. The electrode 100 in FIG. 5*a* has the end adjacent to a spark gap shaped in a hemisphere 101. A coaxial hole 102 is formed through the hemisphere's rounded surface. The intersection of the hemisphere surface and the hole walls forms a sharpened circular ridge 103.

Figure 5A:
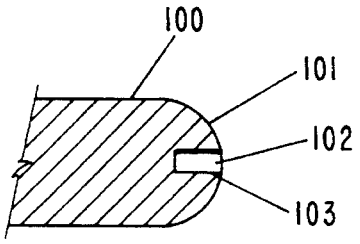
FIGS. 5*a*–5*d* show several other electrode embodiments according to the present invention.
Figure 5B:
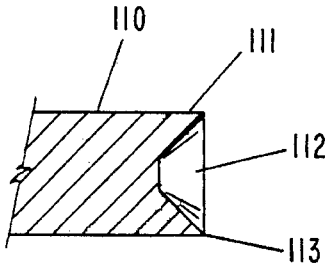

The electrode 110 in FIG. 5*b* has straight outer walls 111. The end of the electrode has a coaxial hole 112 that decreases in diameter with increasing depth. The outer edge of the hole forms a ridge 113 in the electrode face adjacent to a spark gap.

Figure 5C:
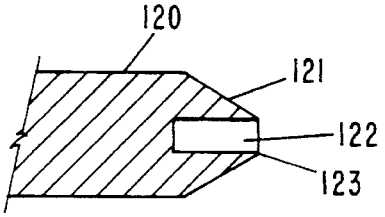
Figure 5D:
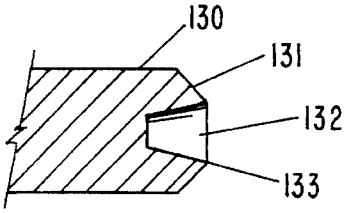

The electrode 120 in FIG. 5*c* has one end smoothly tapering to a reduced cross section. The end has a coaxial hole 122 that intersects the tapered walls 121. The intersection of the tapered walls 121 and the hole 122 forms a ridge 123 in the electrode end adjacent to a spark gap. The electrode 130 in FIG. 5*d* has one end smoothly tapering to a reduced cross section. The end of the electrode has a coaxial hole 132 that decreases in diameter with increasing depth. The intersection of the tapered walls 131 and the hole 132 forms a ridge 133 in the electrode end adjacent to a spark gap.

Figure 6:
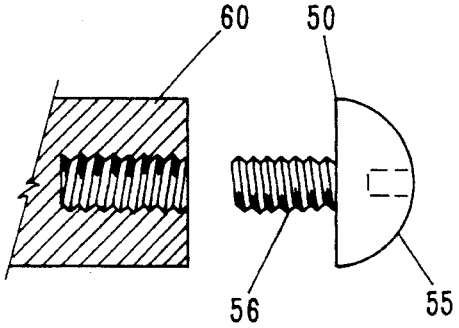
FIG. 6 shows an electrode insert according to the present invention.

Because this invention concentrates the spark at a particular portion of the electrode, that portion may be more susceptible to wear. Also, it is desirable to be able to retrofit existing spark gaps with the present invention. The invention therefore can also be made as a removable insert as shown in FIG. 6. This insert 50 can be used to modify a prior art spark gap electrode 60 to realize the benefits of this invention. The electrode end 55 can be of various shapes as described above. The insert has a second end 56 adapted to be held in a prior art spark gap electrode 60. This can be accomplished in various ways apparent to those skilled in the art, such as threading the insert and the spark gap electrode or soldering the insert into the electrode. The prior art spark gap electrode can be modified to accept the new electrode insert. The electrode insert can be installed in the electrode. The spark gap can then exhibit the reduced breakdown voltage jitter possible with the present invention.

Figure 7:
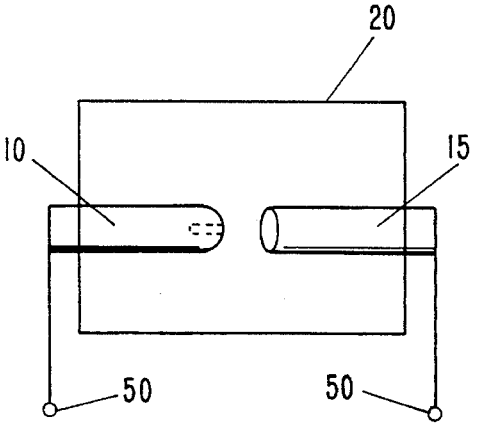
FIG. 7 shows a spark gap device according to the present invention.

FIG. 7 shows a spark gap device made according to the present invention. A first electrode 10 according to the present invention is held in proximity to a second electrode 15 made according to the prior art. The two electrodes can be held in a chamber 20 with a gas 40 to be broken down to produce a spark. The two electrodes can be connected to a source of electrical energy via terminals 50. The first electrode should be the cathode since electron-based spark gap closure (the point when the gas breaks down and the gap becomes conductive) is more predictable than ion-based conduction. The second electrode can be made with a flat surface presented to the spark gap since the breakdown will be initiated by the first electrode. The distance between the electrodes can be on the order of 0.01 to 0.5 inches, and can be varied depending on the performance desired. The electrodes can be made of any conductive material machined or formed to appropriate shapes. Examples of suitable electrode material include copper, brass, tungsten, steel, and graphite-impregnated sintered bronze (such as used in electric starting motor brushes).

Figure 8:
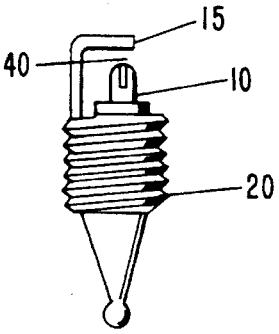
FIG. 8 shows an embodiment of the invention adapted for use in an internal combustion engine.

FIG. 8 shows a spark plug according to the present invention suitable for use in an internal combustion engine. One electrode 10 is shaped to present a ridge to the spark gap. A second electrode 15 can present a flat surface to the spark gap. The electrodes can be held in a conventional housing 20. The gas 40 to be broken down is typically a fuel-air mixture, ignited by the pulsed heat released by the spark that results from the gas breakdown.

Figure 9:
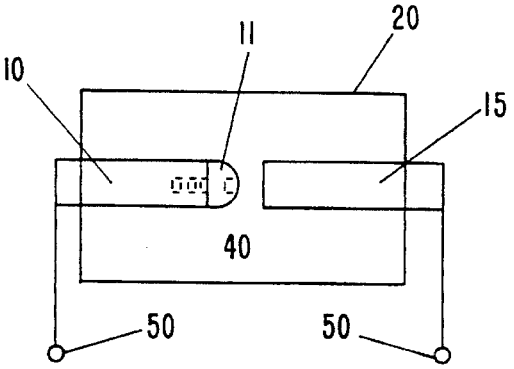
FIG. 9 shows a spark gap according to the present invention.

FIG. 9 shows a spark gap device according to the present invention. A first electrode 10, made of copper, is adapted to fit an electrode insert 11 like that in FIG. 6. The electrode insert 11 is made of graphite-impregnated sintered bronze, a material commonly found in electric starting motor brushes. A second electrode 15 can be made of copper and have a flat surface adjacent to the gap. The electrodes 10,15 and sulfur hexafluoride gas 40 are held by a housing 20. The electrodes 10, 15 are held approximately 0.030 inches apart. The electrodes 10, 15 can be connected to a source of electrical energy via terminals 50. The electrode 10 is connected as the cathode, the electrode 15 is connected as the anode. This spark gap has demonstrated breakdown voltage jitter of only 5% in experiments, compared to over 50% in a similar spark gap without the new electrode end 11.

Other embodiments of this principle will also be apparent to those skilled in the art. The particular geometries and number of the electrodes can be varied. A variety of materials can be employed in the fabrication of the electrodes. Many gasses can be used between the electrodes, including nitrogen, hydrogen, air, sulfur hexafluoride. The electrodes can be held suitable distances apart by various means, such as by mounting both electrodes fixably in a common housing.

The particular sizes and equipment discussed above are cited merely to illustrate a particular embodiment of the invention. It is contemplated that the use of the invention may involve components having different sizes and shapes as long as the principle, the presentation of a controlled electrode ridge to the spark gap, is followed. It is intended that the scope of the invention be defined by the claims appended hereto.

We claim:

1. A spark gap with low breakdown voltage jitter, comprising:

a gap comprising the volume of space wherein sparks are generated;

a first electrode formed of a conducting material having a removable insert comprising a first end adjacent to said spark gap, said removable insert having a ridge formed therein so that all other portions of the first electrode are farther from said spark gap than said ridge;

a second electrode formed of a conducting material and located across said spark gap in such a spaced relationship with the first end of said first electrode that the largest density of electric field equipotentials, which are generated between the first and second electrodes when a difference in electrical potential exists between said electrodes, occurs adjacent to said ridge; and means for holding the first and second electrodes in said spaced relationship.

2. The spark gap of claim 1, wherein said removable insert of said first electrode comprises a second end opposing said first end, said second end comprising means for attaching said second end to said first electrode.

3. The spark gap of claim 2, wherein the second end of said removable insert is threaded to screw into said first electrode, and said first electrode is threaded to receive said second end of said removable insert.

4. The spark gap of claim 1, wherein said first end of said first electrode has a substantially hemispherical shape, a depression disposed substantially coaxial with the hemispherical shape, said ridge being defined by the intersection of the hemisphere's rounded surface and the edge of said depression.

5. The spark gap of claim 1, wherein said first electrode has a cross section substantially circular in shape adjacent to said first end, said first end tapering to a cross-section of a reduced diameter to form a taper with walls, and said ridge being defined by the intersection of the walls of said taper of the first end and the walls of a depression disposed substantially coaxial with said taper.

6. The spark gap of claim 1, wherein said first end is of substantially cylindrical form and comprising cylindrical walls, said ridge being defined by the intersection of the cylindrical walls of said first end with a hole shaped like a sector of a sphere, said hole being disposed substantially coaxially with the first end and having a diameter equal to that of the first end.

7. The spark gap of claim 1, wherein said first end is of substantially cylindrical form and comprising cylindrical walls, said ridge being defined by the intersection of the cylindrical walls of said first end with a conical hole, said hole being disposed substantially coaxially with the first end and having a diameter equal to that of the first end.

8. The spark gap of claim 1, wherein the conductive materials are chosen from the group consisting of graphite, graphite-impregnated sintered bronze, copper, brass, tungsten, and steel.

9. The spark gap of claim 1 further comprising means for containing a gas between the first and second electrodes.

10. The spark gap of claim 9, wherein the gas contained is chosen from the group consisting of air, nitrogen, hydrogen, and sulfur hexafluoride.

11. A spark gap with low breakdown voltage jitter, comprising:

a first end, comprising a conducting material, and substantially possessing an axis of rotational symmetry;

a first electrode, comprising a conducting material and a means for attaching said first end;

a second electrode, comprising a conducting material;

means for holding the first and second electrodes in spaced relationship such that the first and second electrodes are substantially aligned along a common axis of rotational symmetry, said first and second electrodes being separated by a gap; and, a ridge, formed on the first end, said ridge having symmetry about the axis of rotational symmetry of the first end, and all other portions of the first end and first electrode being farther from the gap than said ridge when the first end is attached to the first electrode.

* * * * *